US009257049B2

(12) United States Patent
Axtell et al.

(10) Patent No.: US 9,257,049 B2
(45) Date of Patent: Feb. 9, 2016

(54) METHOD FOR MANAGEMENT OF AIR TRAFFIC CONTROL CENTER DATABASE USED FOR AIR TRAFFIC CONTROL CENTER LOGON

(71) Applicant: Honeywell International Inc., Morristown, NJ (US)

(72) Inventors: Craig Deon Axtell, Peoria, AZ (US); Thomas D. Judd, Woodinville, WA (US); Ronald Alan Diamant, Phoenix, AZ (US); Scott Madaras, Peoria, AZ (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/249,593

(22) Filed: Apr. 10, 2014

(65) Prior Publication Data

US 2015/0213720 A1 Jul. 30, 2015

Related U.S. Application Data

(60) Provisional application No. 61/933,082, filed on Jan. 29, 2014.

(51) Int. Cl.
*G06G 7/76* (2006.01)
*G08G 5/00* (2006.01)

(52) U.S. Cl.
CPC ..... *G08G 5/0095* (2013.01); *G08G 5/0013* (2013.01)

(58) Field of Classification Search
CPC ..... G08G 5/0095
USPC ..... 701/120
See application file for complete search history.

(56) References Cited

U.S. PATENT DOCUMENTS 5,765,172 A * 6/1998 Fox ..... 1/1
6,405,364 B1 * 6/2002 Bowman-Amuah ..... 717/101

(Continued)

FOREIGN PATENT DOCUMENTS

EP 1955304 6/2010
EP 1955303 6/2011

(Continued)

OTHER PUBLICATIONS

European Patent Office, "Extended European Search Report from EP Application No. 15152040.0 mailed Jun. 25, 2015", "from Foreign Counterpart of U.S. Appl. No. 14/249,593", Jun. 25, 2015, pp. 1-8, Published in: EP.

*Primary Examiner* — Mary Cheung
*Assistant Examiner* — Michael Berns
(74) *Attorney, Agent, or Firm* — Fogg & Powers LLC

(57) ABSTRACT

An avionics system includes a human-machine interface (HMI), wherein the HMI includes a display device that displays information to an operator and an input device that receives input from an operator; a storage device that stores master air traffic control (ATC) center data; a memory device that stores separately loaded ATC center data and hard-coded ATC center data, and a processing device communicatively coupled to the HMI, the storage device and the memory device. The processing device compares the separately loaded ATC center data with the hard-coded ATC center data; requests operator validation of changes between the separately loaded ATC center data and the hard-coded ATC center data using the HMI; and updates the master ATC center data when the operator validates the changes between the separately loaded ATC center data and the hard-coded ATC center data.

20 Claims, 7 Drawing Sheets

(56) References Cited

U.S. PATENT DOCUMENTS

| | | | | |
|---|---|---|---|---|
| 6,438,468 | B1 | 8/2002 | Muxlow et al. | |
| 6,463,383 | B1 * | 10/2002 | Baiada et al. | 701/120 |
| 7,203,596 | B2 * | 4/2007 | Ledingham et al. | 701/120 |
| 7,495,602 | B2 * | 2/2009 | Sandell | G08G 5/0013 342/37 |
| 7,647,139 | B2 * | 1/2010 | Sandell | G08G 5/0082 701/120 |
| 7,840,770 | B2 | 11/2010 | Larson et al. | |
| 7,860,642 | B2 * | 12/2010 | Sandell | G08G 5/0013 701/120 |
| 8,193,947 | B2 * | 6/2012 | McGuffin et al. | 340/961 |
| 8,427,343 | B2 * | 4/2013 | McGuffin et al. | 340/961 |
| 8,516,150 | B2 | 8/2013 | Darr et al. | |
| 8,768,540 | B2 * | 7/2014 | Stone et al. | 701/3 |
| 8,849,476 | B2 * | 9/2014 | Coulmeau | 701/14 |
| 2006/0075004 | A1 | 4/2006 | Stakutis et al. | |
| 2010/0023602 | A1 | 1/2010 | Martone | |
| 2011/0057830 | A1 * | 3/2011 | Sampigethaya et al. | 342/36 |
| 2012/0254345 | A1 | 10/2012 | Montoya | |
| 2013/0024850 | A1 | 1/2013 | Nutaro et al. | |
| 2014/0372018 | A1 * | 12/2014 | Srinivasan | G08G 5/0013 701/120 |

FOREIGN PATENT DOCUMENTS

| | | |
|---|---|---|
| EP | 2814019 | 12/2014 |
| WO | 2007064734 | 6/2007 |

* cited by examiner

METHOD FOR MANAGEMENT OF AIR TRAFFIC CONTROL CENTER DATABASE USED FOR AIR TRAFFIC CONTROL CENTER LOGON

CROSS-REFERENCE TO RELATED APPLICATIONS

This application claims the benefit of U.S. Provisional Patent Application Ser. No. 61/933,082, filed on Jan. 29, 2014, which is hereby incorporated herein by reference.

BACKGROUND

Air traffic control (ATC) centers are used at most airports to coordinate take-offs, landings, and general aircraft traffic around the airport. Traditionally, a pilot uses a radio to speak to an ATC center to request permission or to receive instructions from the ATC center. With increasing air traffic, it has become difficult for ATC centers and pilots to process all of the oral communications with aircraft without error. Consequently, data link applications have been developed to provide textual communications between pilots and air traffic controllers.

One of these data link applications, called Controller Pilot Data Link Communication (CPDLC), provides for the direct exchange of text-based messages between a controller and a pilot. The CPDLC application enables the pilot to communicate electronically with an ATC center by guiding the pilot through a series of screen configurations or displays that either elicit flight information from the pilot or notify the pilot regarding flight information, including requesting and receiving ATC clearances. The CPDLC application may be part of a larger flight information/control program or may serve as a stand-alone program.

To have electronic message communication through CPDLC and context management (CM), the pilot must first enter an ATC center name that is confirmed by an avionics computer. In current CPDLC systems, avionics systems such as a Communication Management Unit (CMU) or a Flight Management Computer (FMC) include interfaces configured to allow pilots and/or flight crews to select or confirm the entry of the desired ATC center from the list of available ATC centers. In some embodiments, a Human-Machine Interface (HMI) used for selecting an ATC center that is common to many aircraft avionics is the Multifunction Control Display Unit (MCDU). In some current applications, the pilot and/or flight crew is required to scroll through the list of available ATC centers to find and select the desired ATC center. In some current applications, the ATC centers are listed in the order in which they are stored in a database. The list of ATC centers in the world is over 100 now. The list of ATC centers that are available, however, may change over time.

SUMMARY

An avionics system includes a human-machine interface (HMI), wherein the HMI has at least one display device configured to display information to an operator and at least one input device configured to receive input from an operator; at least one storage device configured to store master air traffic control center data; at least one memory device configured to store separately loaded air traffic control center data and hard-coded air traffic control center data, and at least one processing device communicatively coupled to the at least one HMI, the at least one storage device, and the at least one memory device. The at least one processing device is configured to compare the separately loaded air traffic control center data with the hard-coded air traffic control center data; request operator validation of changes between the separately loaded air traffic control center data and the hard-coded air traffic control center data using the HMI; and update the master air traffic control center data when the operator validates the changes between the separately loaded air traffic control center data and the hard-coded air traffic control center data.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
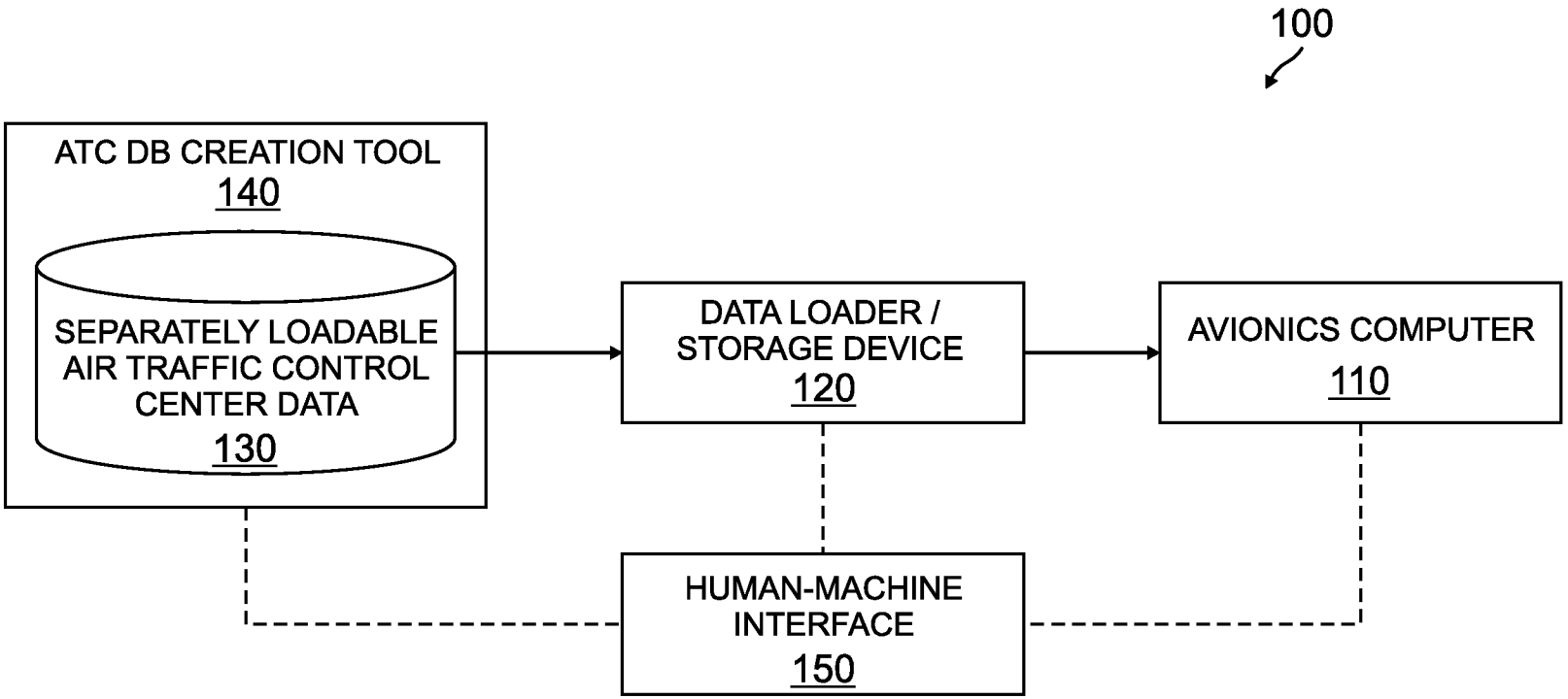
FIG. 1 is a block diagram of an example system to improve management of an ATC Center Database used for ATC Center logon.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, methods presented in the drawing figures and the specification are not to be construed as limiting the order in which the individual steps may be performed. The following detailed description is, therefore, not to be taken in a limiting sense.

As stated above, the list of ATC centers will change over time. Moreover, in the coming years, the list of ATC centers and the associated ATC centers are expected to be dynamic. It is therefore desirable that systems and methods be developed to keep the list of ATC centers up to date. The design changes described in this disclosure will allow for validation of a change in ATC centers by operators with an approach that is more streamlined than current designs. In some conventional systems, the database of ATC centers is maintained in the following manner. An industry publication lists the ATC centers that are available for communicating via an aeronautical telecommunication network (ATN). A separately loadable database is then constructed that has these data centers as records that include the relevant information for each ATC center. In current implementations, this separately loadable database has about 120-130 centers in it. If there is an update to the ATC list, the separately loadable database will change to incorporate the update. For example, a new ATC center could be added; an existing ATC center could change; or, an ATC center could be deleted. Once the separately loadable database changes to incorporate the update, if the update is wrong, then this may contribute to a minor aircraft "hazard". A minor hazard results in a requirement that the FAA's certification requirements be enacted. The FAA's approval of the changes to the separately loadable ATC database is addressed under the FAA's Operational Guidance for the design described in this disclosure.

Using conventional systems and methods, where all ATC centers and addresses are contained in the ATC Database (DB), Type Design approval is needed for ATC center and center address updates. The systems and methods described in this disclosure, however, eliminate the need to get Type Design approval of changes to the ATC centers and associated addresses after the type design is approved. More specifically, when the operational software goes through the certification process and Type Design approval, all of the ATC centers will be hard-coded and stored in the operational software. The hard-coded ATC centers will go through the certification approval at the time the operational software is implemented. Once the operational software is implemented and the ATC centers are hard-coded into the software, the separately loadable database should not have any changes to the ATC centers that need to be implemented into the operational software. Over time though, there are likely to be changes to the ATC centers. If there are, the changes will be created in the separately loadable database. These changes will be substantially fewer than under the conventional implementations since the list of ATC centers is already hard-coded into the communication system. Since there will only be a few changes to be made, the operators of the operational software, e.g., the airlines, can either reject or accept the changes. This will eliminate the need to get Type Design approval for the changes to the hard-coded ATC centers, which is necessary using conventional systems.

FIG. 1 is a block diagram of an exemplary embodiment of an avionics system 100 to improve management of an ATC Center Database used for ATC Center logon. More specifically, the avionics system 100 includes an avionics computer 110, a data loader/storage device 120, separately loadable air traffic control center data 130, an ATC Database (DB) Creation Tool 140 and at least one human-machine interface (HMI) 150. The avionics computer 110 has one or more memory devices and one or more storage devices wherein hard-coded air traffic control center data is stored in the one or more memory devices and master air traffic control center data is stored in the one or more storage devices. In some embodiments, the system functions as follows. When there are updates to the ATC center data, the ATC DB Creation Tool 140 creates a separately loadable database (SLDB) 130 including the updated air traffic control center data. In exemplary embodiments, this is done by an ATC DB Creation Tool 140 operator inputting data into the ATC DB Creation Tool 140 via at least one HMI 150, which the ATC DB Creation Tool 140 then uses to create the SLDB 130. In other embodiments, data can be put into the ATC DB Creation Tool 140 using another computer or other automated process. This SLDB 130 is loaded into the avionics computer 110 by a data loader/storage device 120, wherein the avionics computer 110 is configured to compare the SLDB 130 with hard-coded air traffic control center data (HCDB) that is stored on the avionics computer 110. In exemplary embodiments, maintenance personnel can operate the data loader/storage device 120 in order to load the SLDB 130 into the avionics computer 110. If the data in the SLDB 130 does not match the data in the HCDB, then an operator can validate the changes between the SLDB and the HCDB using the at least one human-machine interface (HMI) 150. If the changes are validated, the avionics computer 110 updates master air traffic control center data (MDB), which is also stored on the avionics computer 110. Each of the components and their interrelationship are described in more detail below.

As shown in FIG. 1, at least one HMI 150 can be included in or communicatively coupled to some or all of the following: the ATC DB Creation Tool 140, the data loader/storage device 120, and the avionics computer 110. In some embodiments, each device can have its own HMI 150. The at least one HMI 150 can be used whenever the system and methods described below require an operator to input data, validate data, and/or display data. As a result, each of the at least one HMI 150 has at least one display device configured to display information to an operator and at least one input device configured to receive input from an operator. Suitable technologies for implementing the display unit include, but are not limited to, a cathode ray tube (CRT) display, an active matrix liquid crystal display (LCD), a passive matrix LCD, or plasma display unit. Exemplary display units include, but are not limited to, a display associated with the Flight Management System (FMS)/Flight Management Computer (FMC) itself, a multiple function display (MFD), a multiple function touch screen, and/or a display associated with a Communications Management Unit (CMU)/Communications Management Function (CMF). The user input device can be implemented as, but is not limited to, keyboards, touch screens, microphones, cursor control devices, line select buttons, glareshield buttons, etc. In some embodiments, the user input device comprises more than one type of input device. In some embodiments, the HMI can be implemented in an input device and coupled to a Communication Management Unit (CMU) and/or CMF and/or Flight Management Computer (FMC) and/or part of a Flight Management System (FMS) and/or part of an Electronic Display System (EDS).

Figure 2:
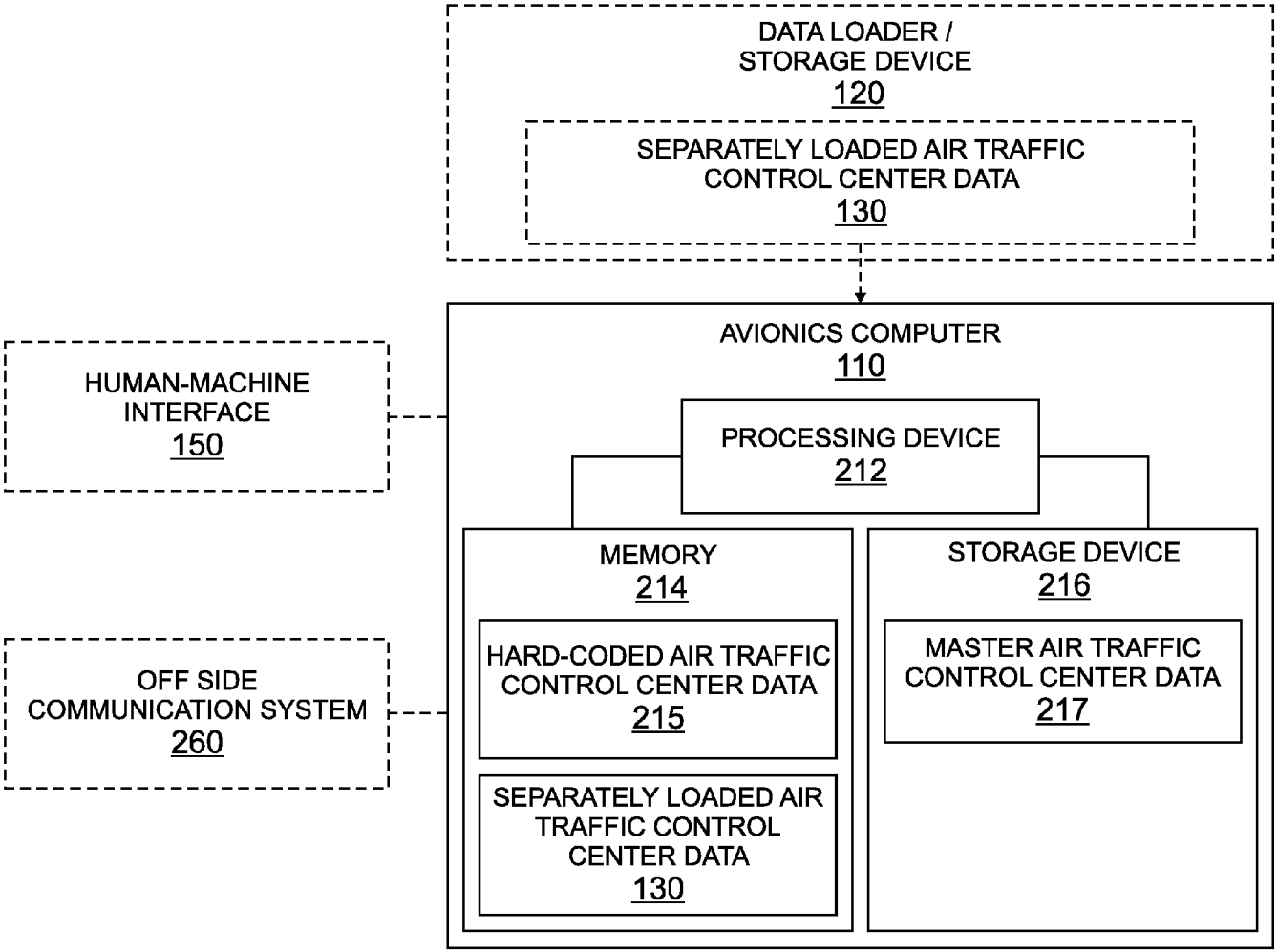
FIG. 2 is a block diagram of an example avionics computer used to improve management of an ATC Center Database.

FIG. 2 shows an expanded view of the avionics computer 110 in FIG. 1. An avionics computer 110, as used herein, may include a communications management unit (CMU)/Communications Management Function (CMF), a flight management computer, data radios, a flight management function, and/or other avionics computers. The avionics computer 110 includes at least one storage device 216 configured to store master air traffic control center database (MDB) 217, at least one memory device 214 configured to store hard-coded air traffic control center database (HCDB) 215 and at least one processing device 212 communicatively coupled to the at least one human-machine interface 150, the at least one storage device 216 and the at least one memory device 214, wherein the at least one processing device 212 is configured to compare the separately loadable database (SLDB) 130 with the HCDB 215. Moreover, the at least one processing device 212 is configured to request operator validation of changes between the SLDB 130 and the HCDB 215 using the human-machine interface 150. After which, the processing unit 212 is configured to update the MDB 217 when the operator validates the changes between the SLDB 130 and the HCDB 215. The most up-to-date ATC center data is then stored in the MDB 217 for which an operator of an aircraft can use. Moreover, for backup and/or redundancy purposes, in some embodiments, the data in the MDB 217 may be stored in at least one offside communication system 260, as well. In some embodiments, the at least one offside communication system includes a single offside communication system. In other embodiments, the at least one offside communication system includes more than one system (e.g., two offside communication systems). In some embodiments, the at least one offside communication system can be at least one redundant system to the primary system. In other embodiments, the at least one offside communication system can be different than the primary system.

The processing device 212, as described herein, includes or functions with software programs, firmware or other computer readable instructions for carrying out various methods, process tasks, calculations, and control functions, used in the configuration instructions described above. These instructions are typically stored on any appropriate computer readable medium used for storage of computer readable instructions or data structures. The computer readable medium can be implemented as any available media that can be accessed by a general purpose or special purpose computer or processor, or any programmable logic device. Suitable processor-readable media may include storage or memory media such as magnetic or optical media. For example, storage or memory media may include conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc. Suitable processor-readable media may also include transmission media such as electrical, electromagnetic, or digital signals, conveyed via a communication medium such as a network and/or a wireless link. In some embodiments, the instructions can be included in the memory 214, the storage device 216, and/or stand-alone memory (not shown).

As previously stated, the processing device 212 is configured to compare the SLDB 130 with the HCDB 215, for which the differences are then used to update the MDB 217. Before doing so, however, the SLDB 130 needs to be constructed. The ATC center updates can come from a variety sources, as known to one having skill in the art, with one example being the industry publication from the International Civil Aviation Organization (ICAO). When there are changes to the ATC center data, various tools can be used to create the SLDB 130. An example of an ATC DB Creation Tool is the Certified ACARS Reconfiguration Tool (CART Tool) 140. In some embodiments where an ATC DB Creation Tool 140 is used, the ATC DB Creation Tool 140 can be communicatively coupled to a data loader/storage device 120, which is then communicatively coupled to the avionics computer 110, so that the generated SLDB 130 can be loaded onto the avionics computer 110. In some other embodiments, the ATC DB Creation Tool 140 can load the SLDB 130 onto a media device and the media device can then transfer the SLDB 130 to the data loader/storage device 120. In even other embodiments, the ATC DB Creation Tool 140 can load the SLDB 130 onto a media device, which is the data loader/storage device 120, and the media device can load the SLDB onto the avionics computer 110.

Figure 3:
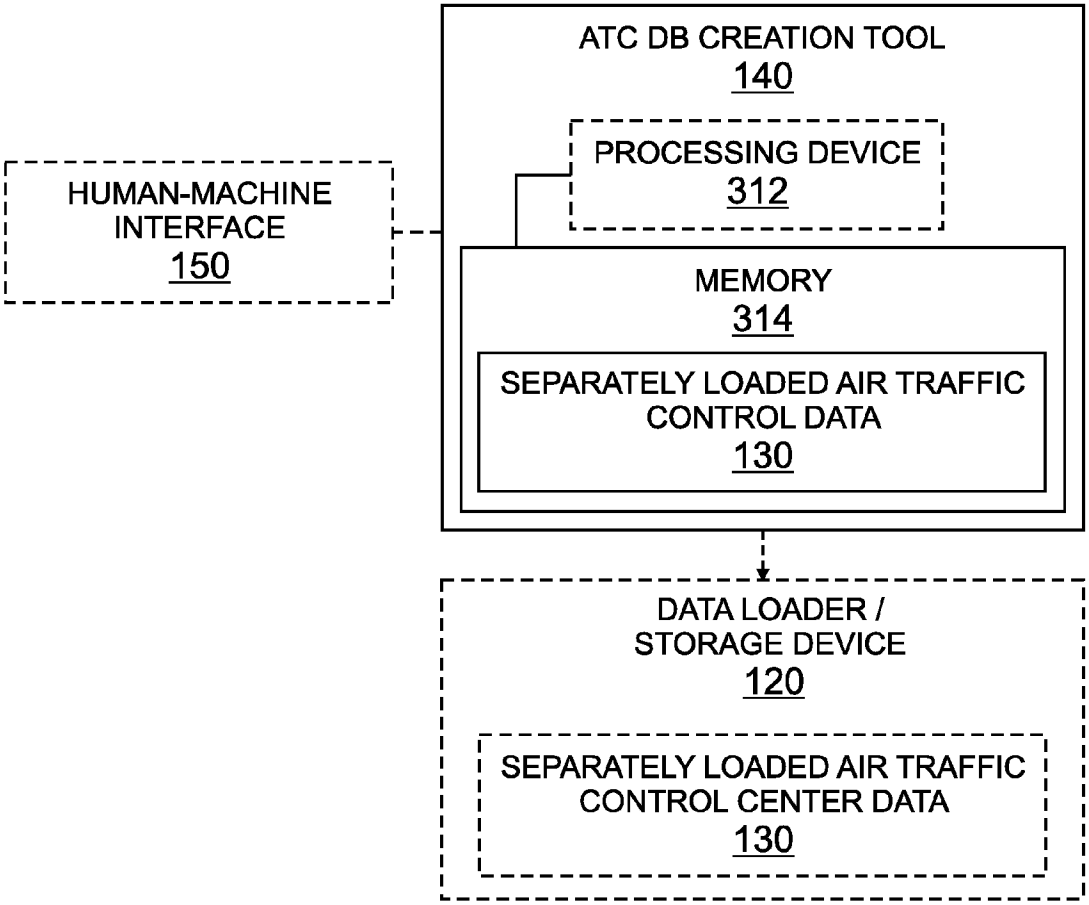
FIG. 3 is a block diagram of an example ATC Database (DB) Creation Tool used to improve management of an ATC Center Database.

FIG. 3 shows an example of an ATC DB Creation Tool 140. The ATC DB Creation Tool 140 includes at least one memory device 314 and at least one processing device 312. The memory device 314 can have some or all of the same characteristics as the memory 214 in FIG. 2. Moreover, in some embodiments, the ATC DB Creation Tool 140 can include at least one HMI 150. As stated above, the ATC DB Creation Tool 140 can be used to create the SLDB 130, which is then transferred to the avionics computer 110 using a data loader/storage device 120. That is, more specifically, the ATC DB Creation Tool 140 can include instructions that when executed by its processing device 312 can take the input from an ATC DB Creation Tool operator or other computer, such as updated ATC database information, and create the SLDB 130. These instructions are typically stored on any appropriate computer readable medium used for storage of computer readable instructions or data structures. The computer readable medium can be implemented as any available media that can be accessed by a general purpose or special purpose computer or processor, or any programmable logic device. Suitable processor-readable media may include storage or memory media such as magnetic or optical media. For example, storage or memory media may include conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc. Suitable processor-readable media may also include transmission media such as electrical, electromagnetic, or digital signals, conveyed via a communication medium such as a network and/or a wireless link. In some embodiments, the computer readable medium can be the memory 314 in FIG. 3.

Using the ATC DB Creation Tool 140 to create the SLDB 130 can provide more flexibility and better tracking of ATC center updates than other systems and methods. For example, the ATC DB Creation Tool 140 can be used in exemplary embodiments to manage the version of the SLDB 130 that is used for comparing against the HCDB 215. That is, a version number can be used to identify the version of the SLDB 130 that is created using the ATC DB Creation Tool 140. That version number can then be displayed on the flight deck once the SLDB 130 is compared against the HCDB 215, so that the ATC centers stored in the MDB 217 of the avionic computer 110 can be identified by correlating the version number to the SLDB 130 and therefore, made sure that the ATC centers on the MDB 217 are up to date. In some embodiments, the management of the version numbers can be the responsibility of the ATC DB Creation Tool 140 operator.

To update the ATC center information, some of the following examples can be used. In an example, to modify an existing center, an entry of an ATC center (using the ATC DB Creation Tool 140 to create a SLDB) that is duplicated, but different in the details than the existing ATC center, as stored in the MDB 217, can result in the modification of a center in the MDB 217. In another example, to add a new center, an entry into the ATC DB Creation Tool 140 that is not in the MDB 217 will result in the addition of a new center in the MDB 217. In even another example, an entry in the MDB 217 can be deleted via inclusion of the ATC's center designation in the ATC DB Creation Tool 140 with all address information blank. In other embodiments, an entry in the MDB 217 can be deleted in other ways, such as by including a specific identifier or flag indicating the desired deletion of a specific entry. If there is no change to an existing ATC center, a duplicate entry into the ATC DB Creation Tool 140 that is identical in the MDB 217 will have no impact on the MDB 217. Similarly, an ATC center not included in the ATC DB Creation Tool 140, but included in the MDB 217 will have no effect on the ATC center in the MDB 217.

Once the data for the ATC center updates are entered into the ATC DB Creation Tool 140, the ATC DB Creation Tool 140 can be used to create the SLDB 130, which is used to compare with the HCDB 215. However, if the ATC DB Creation Tool 140, as known to one having skill in the art, is used, some changes can be made to it. For example, the ATC DB Creation Tool 140 may need to be qualified. Qualifying the ATC DB Creation Tool 140, as used herein, refers to the formal process for getting approval to use the ATC DB Creation Tool 140 by the administration responsible for the aviation industry in the country for which the ATC DB Creation Tool 140 is being implemented in. In the United States, this administration agency is the Federal Aviation Agency (FAA). More specifically, to qualify an ATC DB Creation Tool 140, there must be certain requirements for the ATC DB Creation Tool 140, which the ATC DB Creation Tool 140 has to meet, as verified by tests on the ATC DB Creation Tool 140. This ensures that the ATC DB Creation Tool 140 is working correctly. The summary of these tests and a report indicating everything necessary has been done to ensure the ATC DB Creation Tool 140 is working correctly can then be reported to the FAA. Moreover, the ATC DB Creation Tool 140 can be modified to provide the following features: create an SLDB 130 checksum or a Cyclic Redundancy Check (CRC), create a wrapper that supports the appropriate data loaders (such as data loader 120), and request for the ATC DB Creation Tool 140 operator to confirm the contents of the entries (displayed in an HMI for approval) as a final step when building an SLDB 130.

More specifically regarding the request for ATC DB Creation Tool 140 operator confirmation, whoever uses the ATC DB Creation Tool 140 to add, modify, or delete a record of an air traffic control center can be asked to validate the inputted data. This may involve checking the inputted data against the record for which the data was garnered using at least one HMI 150. In addition, the ATC DB Creation Tool 140 can also include a checksum or Cyclic Redundancy Check (CRC) for validating the separately loaded air traffic control data. In this example, only after the data was validated could the data be used to create a SLDB 130 for comparison with the HCDB 215. If the data is not validated, then the information is reinput into the ATC DB Creation Tool 140 to regenerate the SLDB 130 correctly, after which, the new regenerated information can be validated again.

Figure 4:
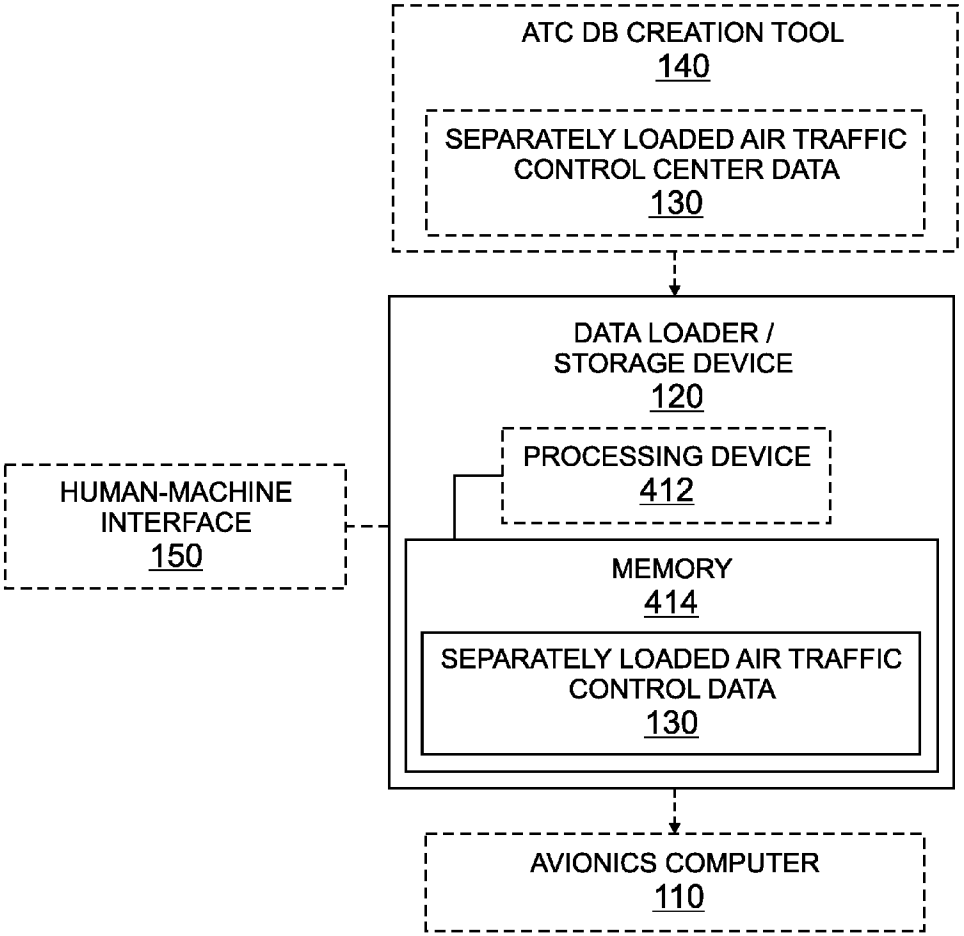
FIG. 4 is a block diagram of an example data loader/storage device used to improve management of an ATC Center Database.

As stated above, after the SLDB 130 is created, a data loader/storage device 120 can be used to load the data into the avionics computer 110. FIG. 4 shows an example of a data loader/storage device 120. In some embodiments, the data loader/storage device 120, as used herein, can be communicatively coupled to the ATC DB Creation Tool 140 and the Avionics Computer 110. In some embodiments, communicatively coupled can mean physically coupled and in some other embodiments, communicatively coupled can mean the ability to communicative via radio with each other. Further, in some embodiments, communicatively coupled can mean the ATC DB Creation Tool 140 is downloaded to a media device, then the media device is inserted into a data loader/storage device 120, which will load the SLDB 130 onto the Avionics Computer 110. In some embodiments, the data loader/storage device 120 can be the media device that receives the SLDB 130 created by the ATC DB Creation Tool 140 and transfers the SLDB 130 to the Avionics Computer 110 by being communicatively coupled at different times to the ATC DB Creation Tool 140 and the Avionics Computer 110, respectively. In exemplary embodiments, the data loader/storage device 120 is only communicatively coupled to the ATC DB Creation Tool 140 while loading the SLDB 130 from the ATC DB Creation Tool 140 into the data loader/storage device 120. In other exemplary embodiments, the SLDB 130 is stored onto storage medium by the ATC DB Creation Tool 140 and the storage medium is then used by the data loader/storage device 120 to load the SLDB 130. A data loader/storage device 120 is a piece of avionics maintenance equipment used to upload new programs and data, such as the SLDB 110, to avionics devices, such as the Avionic Computer 110. In some embodiments, a data loader/storage device 120 can be a device with its own at least one human-machine interface (HMI) 150, processing device 412 and memory 414. The processing device 412 and memory 414 can have some or all of the same characteristics as the processing device 212, 312 and memory 214, 314 as discussed above in FIGS. 2 and 3, respectively. In other embodiments, a data loader/storage device 120 can be a memory device 414, such as a memory card, a data compact disc (CD) player, or another mass storage device. There are a number of ways that the data loader/storage device 120 can be communicatively coupled to the ATC DB Creation Tool 140 and the avionics computer 110. In one embodiment, the data loader/storage device 120 is a separate device and coupled by a technician or operator to a data-loader interface, such as a universal serial bus (USB) connection, on the ATC DB Creation Tool 140 and the avionics computer 110. In another implementation, the data loader/storage device 120 can be a memory card, CD, or the like and communicatively coupled to the ATC DB Creation Tool 140 and/or the avionics computer 110 by inserting the card/CD into a slot in either the ATC DB Creation Tool 140 and/or the avionics computer 110. These embodiments allow simple upgrades generated by the ATC DB Creation Tool 140 to be provided to the avionics Computer 110.

After the SLDB 130 is created and the data loader/storage device 120 is communicatively coupled to the avionics computer 110, the at least one processing device (such as processing device 212 or processing device 412) can compare the SLDB 130 with the HCDB 215 stored in memory 214. In some embodiments, the comparison is done by the processing device 412 in the data loader/storage device 120. In other embodiments, the comparison is done by the processing device 212 in the avionics computer 110. In even other embodiments, the comparison is done by maintenance personnel viewing the differences via a HMI 150. In some embodiments, the processing device 212, 412 may be instructed to perform this comparison during ATC Center logon. If the data in the SLDB 130 is different than the HCDB 215, then the processing device 212, 412 is configured to update the MDB 217 in the storage device 216. The air traffic control center data that is compared can be comprised of data that is needed to identify an air traffic control center in conventional systems. For example, the air traffic control data for each air traffic control center can include some or all of the following: the ATC center designation, center name, and associated ATN address and/or IP address and/or some other network address. When displaying the address, it could be displayed by breaking the address into address fields; for example, as shown in the HMI 150 of FIG. 5A, when displaying the ATN address 502 the following ATN address fields could be displayed: authority and format identifier (AFI) 504, initial domain identifier (IDI) 506, version identifier (VER) 508, administrative identifier (ADM) 510, the routing domain format (RDF) 512, the administrative region selector (ARS) 514, the location identifier (LOC) 516, the system identifier (SYS) 518, the network selector (NSEL), and the transport selector (TSEL) 519. Both the data in the SLDB 130 and the HCDB 215 can be comprised of this data, a variation thereof, or additional data not listed here, but in most embodiments, the data fields that are used in each database will be the same.

The HCDB 215 that is used for comparison against the SLDB 130 can be hard-coded in a master air traffic control center database at an avionics computer 110. This data, as described above, is a complete listing of all the ATC center data that is known at the time the operational software for the master communication system is implemented. Since this data is hard-coded when the operational software is implemented, it goes through the aircraft maker's approval process and is approved by the FAA. The HCDB 215 data can be stored on conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc.

Figure 5A:
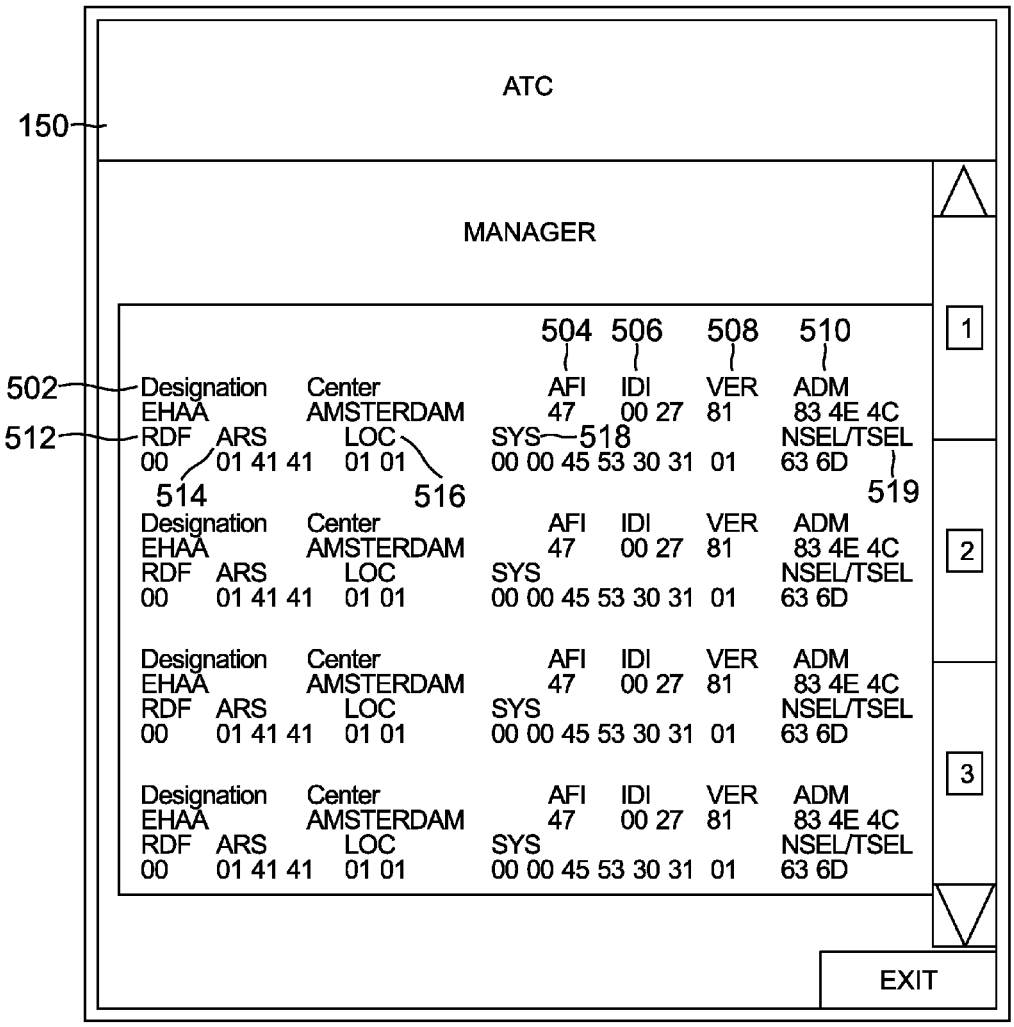
FIG. 5A is an example of a human-machine interface display of ATC center data used to describe an ATC center.
Figure 5B:
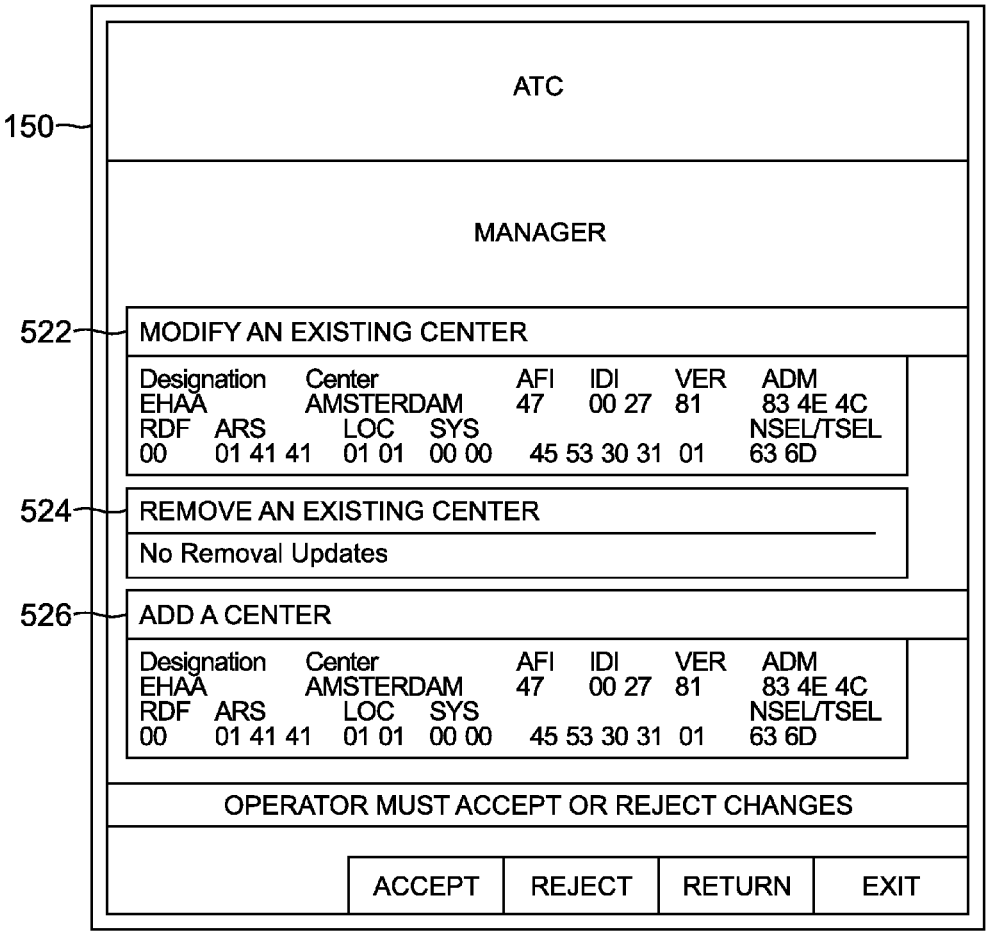
FIG. 5B is an example of a human-machine interface display of updates to ATC center data.

After the comparison is performed, the processing device 212 and/or the processing device 412 can request operator validation of the changes between the SLDB 130 and the HCDB 215 stored in the MDB 217. In an example, the updates can be displayed using at least one avionics HMI 150. As illustrated throughout this disclosure, the at least one HMI 150 that displays the request for operator validation of the changes between the SLDB 130 and the HCDB 215 may be included in the data loader/storage device 120 and/or may be included in the avionics computer 110. FIG. 5B is an example ATC center update validation displayed on an exemplary HMI 150. More specifically, an existing ATC center is modified at 522, no existing ATC centers are removed at 524, and an ATC center is added at 526. To validate the updates, an operator needs to check the data in the SLDB 130 against the source of the data and either confirm the correctness of the data or reject it. For example, if there was an industry wide change to ATC center data, to validate the changes, a system or operator would go to the industry publication that publishes all the ATC center address data, such as a publication of the International Civil Aviation Organization (ICAO) EUR NSAP Address Registry document. Using the industry publication, an operator (such as maintenance personal uploading the SLDB 130 to the aircraft using a data loader/storage device) could check whether the changes in the SLDB 130 match the data in the publication. In another embodiment, a customized address may be involved. In which case, one could then check the data in the SLDB 130 against the source for the customized address. For example, if the new address was used to define a test center that the operator can log on to, then the data in the SLDB 130 can be checked against the data at the center used to create the data in the SLDB 130. After the data in the SLDB 130 is checked against the source, the operator can then either approve the data in the SLDB 130 or reject it. In some embodiments, if there is more than one change, then all of the changes need to be accepted or rejected, even if one of the more than one changes is correct. In other embodiments, if there is more than one change, then an operator can accept or reject each change individually.

Once the operator validates the changes, the processing device 212 can update the MDB 217. That is, the information that was validated can be written to the storage device 216 of the MDB 217. If the information is not validated, then no updates occur to the MDB 217. The storage device 216 on which the MDB 217 is saved can be a rewritable storage device, such as a conventional hard disks, Compact Disk-Read-Write Memory (CD-ROM), on non-volatile Random Access Memory (RAM), Electrically Erasable Programmable ROM (EEPROM), and flash memory, etc. After this update and the other processing instructions described above, the processing device 212 can perform a checksum or CRC. That is, a checksum or CRC can be completed on the following data: the data input in the ATC DB Creation Tool 140, the data in the SLDB 130, the data in the HCDB 215 and when the data is written to the MDB 217.

Figure 6:
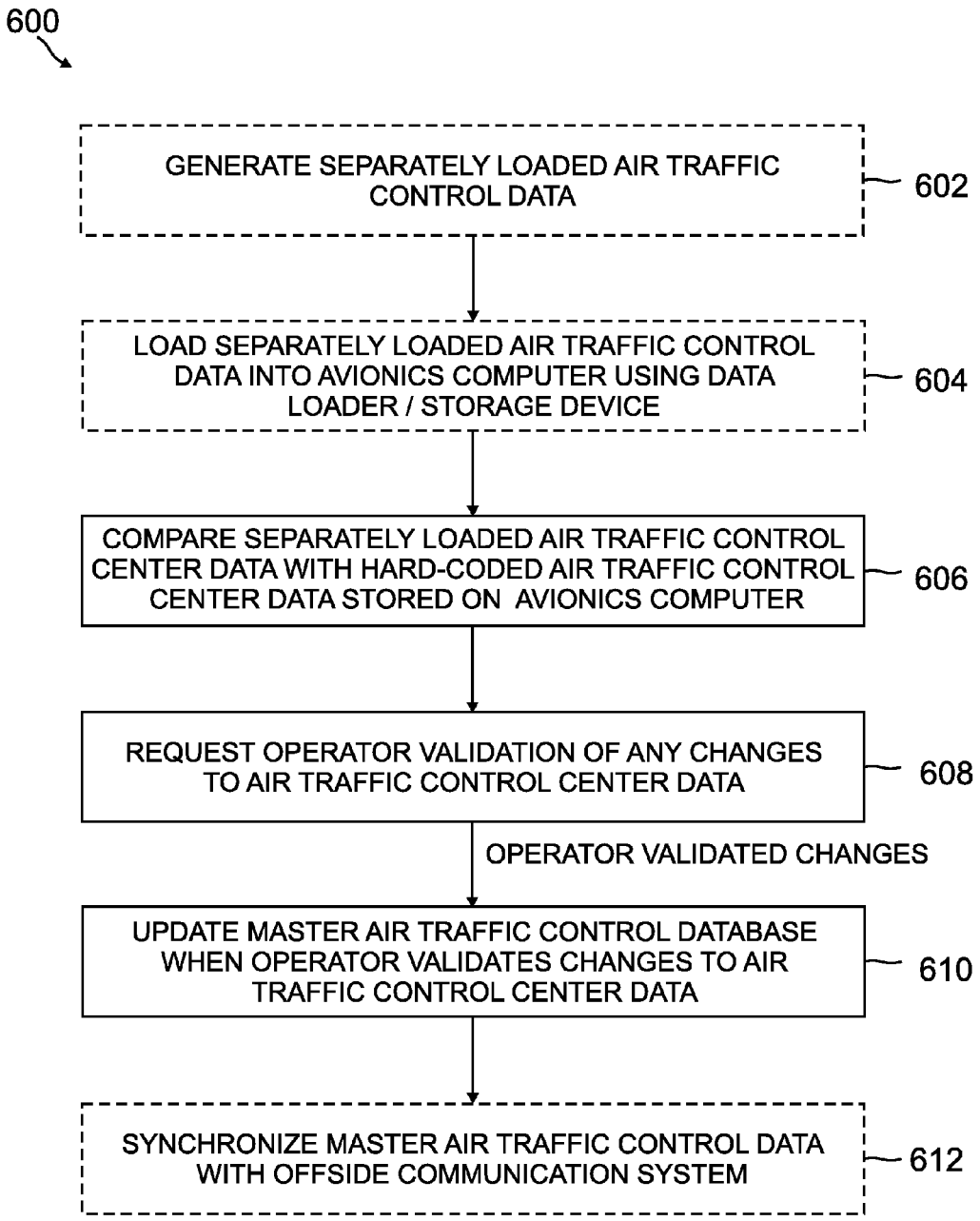
FIG. 6 is a flow diagram of an example method to improve management of an ATC Center Database used for ATC Center logon.

FIG. 6 is a flow diagram of an example method 600 to improve management of the ATC Database used for ATC Center logon. The method 600 comprises generating separately loaded air traffic control data (block 602), loading the SLDB into an avionics computer using a data loader/storage device (block 604), comparing hard-coded air traffic control center data with separately loaded air traffic control center data stored on an avionics computer (block 606); requesting operator validation of any changes to air traffic control center data (block 608); and updating the master air traffic control center database when the operator validates the changes to the air traffic control center data (block 610). Moreover, method 600 can include synchronizing master air traffic control data with an offside communication system (block 612). In addition, in some embodiments, blocks 602, 604 and 612 can be optional. In exemplary embodiments, this method 600 can be performed for ATC Center logon.

As stated above, method 600 includes optionally generating separately loaded air traffic control data (SLDB) (block 602). Similar to the discussion above, to create, modify or delete a record of an ATC center used to populate the SLDB, various ATC DB Creation Tools can be used, with one example being the Certified ACARS Reconfiguration Tool (CART Tool). In some embodiments, the ATC DB Creation Tool can have some or all of the same functionality as discussed above. Once the data for the air traffic control center is entered into the ATC DB Creation Tool, the ATC DB Creation Tool can be used to create the SLDB, which is used to compare with the hard-coded air traffic control center data (HCDB). Moreover, and as similar to above, whoever uses the ATC DB Creation Tool to add, modify, or delete a record of an air traffic control center ATC DB Creation Tool is responsible for accurate input of data and can be required to validate the accuracy of the data.

Method 600 can include optionally loading the SLDB into an avionics computer (block 604). This can be done in a number of ways, one of which is using a data loader/storage device like the data loader/storage device 120 discussed above. More specifically, a data loader/storage device can be communicatively coupled to the device that created the SLDB (e.g., the ATC DB Creation Tool) and communicatively coupled to an avionics computer. At which time, in some embodiments, the SLDB can be transferred onto the avionics computer where block 606 is performed. In other embodiments, once the data loader/storage device is communicatively coupled to the avionics computer, the data loader/storage device can perform the comparison (block 606) before any data is transferred to the avionics computer.

As stated above, the SLDB is compared with the HCDB stored on an avionics computer (block 606). In some embodiments, the comparison of the HCDB with the SLDB may be performed by the Communication Management Unit (CMU). If the data in the SLDB is different than the HCDB, then block 608 can be performed. In some embodiments, the avionics computer can have some or all of the same functionality as the avionics computer discussed above. Moreover, similar to above, the air traffic control center data that is compared can be comprised of data that is needed to identify an ATC center in conventional systems. For example, as shown in FIG. 5A, the air traffic control data for each air traffic control center can include the ATC center designator 502 and ATN address fields: authority and format identifier (AFI) 504, initial domain identifier (IDI) 506, version identifier (VER) 508, administrative identifier (ADM) 510, the routing domain format (RDF) 512, the administrative region selector (ARS) 514, the location identifier (LOC) 516, the system identifier (SYS) 518, the network selector (NSEL), and the transport selector (TSEL) 519. Both the data in the SLCB and the HCDB can be comprised of this data, a variation thereof, or additional data not listed here, but in most embodiments, the data fields that are used in each database will be the same.

The HCDB that is used for comparison against the SLDB can be hard-coded in a master air traffic control center database on an avionics computer. This data, as described above, is a complete listing of all the ATC center data that is known at the time the operational software for the master communication system is implemented. Since this data is hard-coded when the operational software is implemented, it goes through the aircraft maker's approval process and is approved by the FAA. The HCDB data can be stored on conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc.

After the comparison is performed (block 606), method 600 comprises requesting an operator validating the changes between the SLDB and the HCDB stored in the master air traffic control center database (MDB) (block 608). In an example, the comparison can be done using at least one HMI, as described above. Moreover, in some embodiments, the at least one HMI can be a part of the data loader/storage device that is communicatively coupled to the avionics computer. And, in other embodiments, the HMI can be a part of the avionics computer or can be connected to the avionics computer. Similarly, FIG. 5B is an example of SLDB displayed on a human-machine interface. In some embodiments to validate the information, an operator needs to check the data in the SLDB against the source of the data and either confirm the correctness of the data or reject it, as described above.

Once the operator validates the changes (block 608), the master air traffic control center database can be updated (block 610). That is, the information that was validated in block 608 can be written to the storage device of the master air traffic control database. If the information is not validated, then no updates occur to the master air traffic control center database. The master air traffic control database can be stored rewritable storage devices, such as on conventional hard disks, Compact Disk-Read-Write Memory (CD-ROM), on non-volatile Random Access Memory (RAM), Electrically Erasable Programmable ROM (EEPROM), and flash memory, etc. Moreover, once the master air traffic control center database is updated (block 610), the data can be optionally backed up by synchronizing it with an offside communication system (block 612). In some embodiments, the offside communication system can be more than one system (e.g., two offside communication systems). In some embodiments, the one or more offside communication systems can be redundant systems to the primary system. In other embodiments, the offside communication systems can be different than the primary system.

In each of the blocks above, method 600 can also comprise validating a checksum or cyclic redundancy check (CRC). That is, for the data input in the ATC DB Creation Tool, the data in the SLDB, the data in the HCDB and when the data is written to the master ATC DB.

Using the methods and systems described above, the minor hazard associated with the ATC DB can be mitigated and the expense of responding to the minor hazards is reduced.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

EXAMPLE EMBODIMENTS

Example 1 includes an avionics system comprising: at least one human-machine interface, wherein the at least one human-machine interface includes at least one display device configured to display information to an operator and at least one input device configured to receive input from an operator; at least one storage device configured to store master air traffic control center data; at least one memory device configured to store separately loaded air traffic control center data and hard-coded air traffic control center data, and at least one processing device communicatively coupled to the at least one human-machine interface, the at least one storage device, and the at least one memory device, wherein the at least one processing device is configured to: compare the separately loaded air traffic control center data with the hard-coded air traffic control center data; request operator validation of changes between the separately loaded air traffic control center data and the hard-coded air traffic control center data using the human-machine interface; and update the master air traffic control center data when the operator validates the changes between the separately loaded air traffic control center data and the hard-coded air traffic control center data.

Example 2 includes the avionics system of Example 1, wherein no updates occur to the master air traffic control data when the operator does not validate the changes between the separately loaded air traffic control center data and the hard-coded air traffic control center data using the avionics system.

Example 3 includes the avionics system of any of Examples 1-2, wherein when the processing device requests operator validation, the at least one processing device is configured to request that the operator validate all of the changes between the separately loaded air traffic control center data and the hard-coded air traffic control center data, wherein if one or more of the changes are not validated by the operator, then all of the changes are rejected.

Example 4 includes the avionics system of any of Examples 1-3, wherein when the processing device requests operator validation, the at least one processing device is configured to request that the operator validate each change between the separately loaded air traffic control center data and the hard-coded air traffic control center data, wherein each change is validated and accepted individually and only the validated and accepted changes are used to update the master air traffic control center data.

Example 5 includes the avionics system of any of Examples 1-4, wherein the at least one processing device is further configured to: validate at least one of a checksum or a cyclic redundancy check for the separately loaded air traffic control center data; and only request operator validation of the changes between the separately loaded air traffic control center data and the hard-coded air traffic control center data using the human-machine interface when the at least one of the checksum or cyclic redundancy check for the separately loaded air traffic control center data is validated.

Example 6 includes the avionics system of any of Examples 1-5, wherein the at least one processing device is further configured to load the separately loaded air traffic control center data into an avionics computer using at least one of a data loader and a storage device, wherein the avionics computer includes the at least one processing device, the at least one memory device and the at least one storage device.

Example 7 includes the avionics system of any of Examples 1-6, wherein the at least one processing device is further configured to load the separately loaded air traffic control center data into an avionics computer using a data loader, wherein the avionics computer includes the at least one processing device, the at least one memory device and the at least one storage device; and wherein the human-machine interface is incorporated into the data loader.

Example 8 includes the avionics system of any of Examples 1-7, wherein the at least one processing device is further configured to generate the separately loaded air traffic control center data using an air traffic control database creation tool.

Example 9 includes the avionics system of Example 8, wherein when the at least one processing device generates the separately loaded air traffic control center data using an air traffic control database creation tool, the at least one processing device is configured to: create at least one of an air traffic control center data checksum or an air traffic control center cyclic redundancy check; and create a wrapper that supports a loader for loading the separately loaded air traffic control center data.

Example 10 includes the avionics system of any of Examples 8-9, where the at least one processing device is further configured to: display contents of the separately loaded air traffic control data to an operator through a second human-machine interface; and request the operator confirm the contents of the separately loaded air traffic control center data through the second human-machine interface.

Example 11 includes a method comprising: comparing separately loaded air traffic control center data with hard-coded air traffic control center data stored on an avionics computer; requesting operator validation of changes between the separately loaded air traffic control center data and the hard-coded air traffic control center data stored using a human-machine interface; and updating a master air traffic control center database stored at the avionics computer when the operator validates the changes between the separately loaded air traffic control center data and the hard-coded air traffic control center data using the avionics computer.

Example 12 includes the method of Example 11, wherein no updates occur to the master air traffic control center database when the operator does not validate the changes between the separately loaded air traffic control center data and the hard-coded air traffic control center data using the avionics computer.

Example 13 includes the method of any of Examples 11-12, wherein requesting operator validation includes requesting that the operator validate all of the changes between the separately loaded air traffic control center data and the hard-coded air traffic control center data, wherein if one or more of the changes are not approved by the operator, then all of the changes are rejected.

Example 14 includes the method of any of Examples 11-13, wherein requesting operator validation includes requesting that the operator validate each change between the separately loaded air traffic control center data and the hard-coded air traffic control center data, wherein each change is validated and accepted individually and only the validated and accepted changes are used to update the master air traffic control center data.

Example 15 includes the method of any of Examples 11-14, further comprising: validating at least one of a checksum or cyclic redundancy check for the separately loaded air traffic control center data; and only requesting operator validation of the changes between the separately loaded air traffic control center data and the hard-coded air traffic control center data using the human-machine interface when the at least one of the checksum or cyclic redundancy check for the separately loaded air traffic control center data is validated.

Example 16 includes the method of any of Examples 11-15, further comprising: loading the separately loaded air traffic control center data into the avionics computer using at least one of a data loader and a storage device.

Example 17 includes the method of any of Examples 11-16, further comprising: generating the separately loaded air traffic control center data using an air traffic control database creation tool.

Example 18 includes the method of Example 17, wherein generating the separately loaded air traffic control center data using an air traffic control database creation tool includes: creating at least one of an air traffic control center database checksum or an air traffic control center database cyclic redundancy check; and creating a wrapper that supports a loader for loading the separately loaded air traffic control center data.

Example 19 includes the method of any of Examples 17-18, further comprising: displaying contents of the separately loaded air traffic control center data to an operator through a second human-machine interface; and requesting the operator confirm the contents of the separately loaded air traffic control center data through the second human-machine interface.

Example 20 includes an avionic communication apparatus comprising: an air traffic control database creation tool, wherein the air traffic control database creation tool generates separately loaded air traffic control center data; at least one processing device; at least one storage device communicatively coupled to the at least one processing device configured to store master air traffic control center data; and at least one memory device communicatively coupled to the at least one processing device and configured to store hard-coded air traffic control center data and instructions which, when executed by the at least one processing device, cause the at least one processing device to: compare the separately loaded air traffic control center data with the hard-coded air traffic control center data; request operator validation of changes between the separately loaded air traffic control center data and the hard-coded air traffic control center data; and update the master air traffic control center data when the operator validates the changes between the separately loaded air traffic control center data and the hard-coded air traffic control center data.

What is claimed is:

1. An avionics system comprising:

at least one human-machine interface, wherein the at least one human-machine interface includes at least one display device configured to display information to an operator and at least one input device configured to receive input from an operator;

at least one storage device configured to store master air traffic control center address data;

at least one memory device configured to store separately loaded air traffic control center address data and hard-coded air traffic control center address data, and at least one processing device communicatively coupled to the at least one human-machine interface, the at least one storage device, and the at least one memory device, wherein the at least one processing device is configured to:

compare the separately loaded air traffic control center address data with the hard-coded air traffic control center address data;

request operator validation of changes between the separately loaded air traffic control center address data and the hard-coded air traffic control center address data using the human-machine interface; and update the master air traffic control center address data when the operator validates the changes between the separately loaded air traffic control center address data and the hard-coded air traffic control center address data.

2. The avionics system of claim 1, wherein no updates occur to the master air traffic control data when the operator does not validate the changes between the separately loaded air traffic control center address data and the hard-coded air traffic control center address data using the avionics system.

3. The avionics system of claim 1, wherein when the processing device requests operator validation, the at least one processing device is configured to request that the operator validate all of the changes between the separately loaded air traffic control center address data and the hard-coded air traffic control center address data, wherein if one or more of the changes are not validated by the operator, then all of the changes are rejected.

4. The avionics system of claim 1, wherein when the processing device requests operator validation, the at least one processing device is configured to request that the operator validate each change between the separately loaded air traffic control center address data and the hard-coded air traffic control center address data, wherein each change is validated and accepted individually and only the validated and accepted changes are used to update the master air traffic control center address data.

5. The avionics system of claim 1, wherein the at least one processing device is further configured to:

validate at least one of a checksum or a cyclic redundancy check for the separately loaded air traffic control center address data; and only request operator validation of the changes between the separately loaded air traffic control center address data and the hard-coded air traffic control center address data using the human-machine interface when the at least one of the checksum or cyclic redundancy check for the separately loaded air traffic control center address data is validated.

6. The avionics system of claim 1, wherein the at least one processing device is further configured to load the separately loaded air traffic control center address data into an avionics computer using at least one of a data loader and a storage device, wherein the avionics computer includes the at least one processing device, the at least one memory device and the at least one storage device.

7. The avionics system of claim 1, wherein the at least one processing device is further configured to load the separately loaded air traffic control center address data into an avionics computer using a data loader, wherein the avionics computer includes the at least one processing device, the at least one memory device and the at least one storage device; and wherein the human-machine interface is incorporated into the data loader.

8. The avionics system of claim 1, wherein the at least one processing device is further configured to generate the separately loaded air traffic control center address data using an air traffic control center address database creation tool.

9. The avionics system of claim 8, wherein when the at least one processing device generates the separately loaded air traffic control center address data using an air traffic control center address database creation tool, the at least one processing device is configured to:

create at least one of an air traffic control center address data checksum or an air traffic control center cyclic redundancy check; and create a wrapper that supports a loader for loading the separately loaded air traffic control center address data.

10. The avionics system of claim 8, where the at least one processing device is further configured to:

display contents of the separately loaded air traffic control data to an operator through a second human-machine interface; and request the operator confirm the contents of the separately loaded air traffic control center address data through the second human-machine interface.

11. A method comprising:

comparing separately loaded air traffic control center address data with hard-coded air traffic control center address data stored on an avionics computer;

requesting operator validation of changes between the separately loaded air traffic control center address data and the hard-coded air traffic control center address data stored using a human-machine interface; and updating a master air traffic control center address database stored at the avionics computer when the operator validates the changes between the separately loaded air traffic control center address data and the hard-coded air traffic control center address data using the avionics computer.

12. The method of claim 11, wherein no updates occur to the master air traffic control center address database when the operator does not validate the changes between the separately loaded air traffic control center address data and the hard-coded air traffic control center address data using the avionics computer.

13. The method of claim 11, wherein requesting operator validation includes requesting that the operator validate all of the changes between the separately loaded air traffic control center address data and the hard-coded air traffic control center address data, wherein if one or more of the changes are not approved by the operator, then all of the changes are rejected.

14. The method of claim 11, wherein requesting operator validation includes requesting that the operator validate each change between the separately loaded air traffic control center address data and the hard-coded air traffic control center address data, wherein each change is validated and accepted individually and only the validated and accepted changes are used to update the master air traffic control center address data.

15. The method of claim 11, further comprising:

validating at least one of a checksum or cyclic redundancy check for the separately loaded air traffic control center address data; and only requesting operator validation of the changes between the separately loaded air traffic control center address data and the hard-coded air traffic control center address data using the human-machine interface when the at least one of the checksum or cyclic redundancy check for the separately loaded air traffic control center address data is validated.

16. The method of claim 11, further comprising:

loading the separately loaded air traffic control center address data into the avionics computer using at least one of a data loader and a storage device.

17. The method of claim 11, further comprising:

generating the separately loaded air traffic control center address data using an air traffic control center address database creation tool.

18. The method of claim 17, wherein generating the separately loaded air traffic control center address data using an air traffic control center address database creation tool includes:

creating at least one of an air traffic control center address database checksum or an air traffic control center address database cyclic redundancy check; and creating a wrapper that supports a loader for loading the separately loaded air traffic control center address data.

19. The method of claim 17, further comprising:

displaying contents of the separately loaded air traffic control center address data to an operator through a second human-machine interface; and requesting the operator confirm the contents of the separately loaded air traffic control center address data through the second human-machine interface.

20. An avionic communication apparatus comprising:

an air traffic control center address database creation tool, wherein the air traffic control center address database creation tool generates separately loaded air traffic control center address data;

at least one processing device;

at least one storage device communicatively coupled to the at least one processing device configured to store master air traffic control center address data; and at least one memory device communicatively coupled to the at least one processing device and configured to store hard-coded air traffic control center address data and instructions which, when executed by the at least one processing device, cause the at least one processing device to:

compare the separately loaded air traffic control center address data with the hard-coded air traffic control center address data;

request operator validation of changes between the separately loaded air traffic control center address data and the hard-coded air traffic control center address data; and update the master air traffic control center address data when the operator validates the changes between the separately loaded air traffic control center address data and the hard-coded air traffic control center address data.

* * * * *